US009308149B1

(12) United States Patent
Niskey, Jr. et al.

(10) Patent No.: US 9,308,149 B1
(45) Date of Patent: Apr. 12, 2016

(54) NESTING MEDICATION CONTAINER WITH FIXED CAP

(71) Applicants: Charles Jeffrey Niskey, Jr., San Diego, CA (US); Adam Jason Strichman, Mechanicsville, VA (US)

(72) Inventors: Charles Jeffrey Niskey, Jr., San Diego, CA (US); Adam Jason Strichman, Mechanicsville, VA (US)

( * ) Notice: Subject to any disclaimer, the term of this patent is extended or adjusted under 35 U.S.C. 154(b) by 0 days.

(21) Appl. No.: 14/623,786

(22) Filed: Feb. 17, 2015

(51) Int. Cl.

| | |
|---|---|
| ***A61J 1/00*** | (2006.01) |
| ***B65D 8/04*** | (2006.01) |
| ***A61J 1/03*** | (2006.01) |
| *B65D 1/14* | (2006.01) |
| *A61J 7/00* | (2006.01) |
| *A61J 1/14* | (2006.01) |
| *B65D 21/04* | (2006.01) |

(52) U.S. Cl.
CPC ..... *A61J 1/03* (2013.01); *A61J 1/14* (2013.01); *A61J 7/0069* (2013.01); *B65D 1/14* (2013.01); *B65D 21/04* (2013.01)

(58) Field of Classification Search
CPC ..... B65D 83/04; B65D 23/085; B65D 23/14; B65D 23/0857; B65D 25/005; B65D 25/205; B65D 21/04; B65D 21/064; B65D 21/0215; B65D 1/0223; A61J 1/03; A61J 1/14; A61J 1/00; A61J 7/0046; A61J 7/0076; A61J 7/04; A61J 7/0069
USPC ..... 206/534, 520, 503, 511, 459.1, 459.5, 206/815, 822, 530, 540; 229/407; 220/648, 220/669, 608; 40/312, 310
See application file for complete search history.

(56) References Cited

U.S. PATENT DOCUMENTS

| | | | | | |
|---|---|---|---|---|---|
| 3,252,614 | A | * | 5/1966 | Evans | 206/509 |
| 3,308,962 | A | * | 3/1967 | Bryant | 211/74 |
| 3,497,982 | A | * | 3/1970 | Schulz | 40/312 |
| 3,559,865 | A | * | 2/1971 | Field | 229/407 |
| 3,860,309 | A | * | 1/1975 | Brendgord | 312/351 |
| 4,260,069 | A | * | 4/1981 | Juergens | 220/812 |
| 4,312,523 | A | * | 1/1982 | Haines | 40/630 |
| D276,137 | S | * | 10/1984 | Vere et al. | D9/702 |
| 4,881,648 | A | * | 11/1989 | Hagerty | 206/540 |
| D311,799 | S | * | 10/1990 | Embree et al. | D3/294 |
| 5,038,937 | A | * | 8/1991 | DiSesa, Jr. | 206/501 |
| 5,445,397 | A | * | 8/1995 | Evans | 280/47.18 |
| D378,636 | S | * | 4/1997 | Chrisco | D6/443 |
| D395,165 | S | * | 6/1998 | Wilkening et al. | D3/304 |
| D430,728 | S | * | 9/2000 | Horvath et al. | D3/294 |
| D445,311 | S | * | 7/2001 | Emonet et al. | D7/629 |
| 6,352,170 | B1 | * | 3/2002 | Brown et al. | 220/782 |
| D515,313 | S | * | 2/2006 | Uffner et al. | D3/294 |
| D543,843 | S | * | 6/2007 | Gehring et al. | D9/425 |

(Continued)

*Primary Examiner* — Mickey Yu
*Assistant Examiner* — Gideon Weinerth
(74) *Attorney, Agent, or Firm* — Allen IP Law PLC; Leslie C. Allen, Esq.

(57) ABSTRACT

Referring to the invention, there is shown an assembled container for use in dispensing medicine, pharmaceutics, or similar-sized items. The multi-faceted two-part container is a novel truncated pyramidal shape and is an innovative solution to prior pill bottle designs, based on several factors: the container has better container stability over prior bottle shapes; it may be stacked at an angle in a user's home; a hinged lid opening creates easier user access; and the container shape yields greater internal volume (over prior container designs). Further, the container has a large labeling surface area, possesses angled surfaces that allow for easy viewing of redundant labeling medication information on the container by a user, and has container parts that can be manufactured, shipped and assembled in novel ways and at lower costs than traditional pill bottles.

8 Claims, 16 Drawing Sheets

(56) References Cited

U.S. PATENT DOCUMENTS

| | | | | |
|---|---|---|---|---|
| 7,413,082 | B2 | 8/2008 | Adler | |
| D587,898 | S * | 3/2009 | Cetera | D3/203.2 |
| 7,581,656 | B2 * | 9/2009 | Gnepper et al. | 220/608 |
| D631,337 | S * | 1/2011 | Prevost | D9/421 |
| D631,338 | S * | 1/2011 | Prevost | D9/421 |
| D639,669 | S | 6/2011 | Adler | |
| 8,359,816 | B2 | 1/2013 | Guschke | |
| D676,238 | S * | 2/2013 | Wu et al. | D3/294 |
| 8,381,911 | B2 * | 2/2013 | Buchner et al. | 206/538 |
| 8,458,994 | B2 | 6/2013 | Guschke | |
| D690,199 | S | 9/2013 | Lee | |
| 8,814,216 | B2 | 8/2014 | Estep | |
| 2006/0163103 | A1 * | 7/2006 | Adler et al. | 206/459.5 |
| 2008/0190951 | A1 * | 8/2008 | Gallagher et al. | 220/826 |
| 2008/0302744 | A1 * | 12/2008 | Rosenberg | 211/94.01 |
| 2009/0145900 | A1 * | 6/2009 | Maroofian et al. | 220/200 |
| 2009/0301923 | A1 * | 12/2009 | Van Puijenbroek | 206/518 |
| 2010/0006467 | A1 * | 1/2010 | Joseph et al. | 206/508 |
| 2010/0133139 | A1 | 6/2010 | Lowe | |
| 2011/0120905 | A1 * | 5/2011 | Buchner et al. | 206/539 |
| 2012/0132558 | A1 * | 5/2012 | Busch | 206/503 |
| 2013/0320017 | A1 | 12/2013 | Kientzle | |

* cited by examiner

The "Frontwards Stacking" arrangement

The "Rearwards Stacking" arrangement

NESTING MEDICATION CONTAINER WITH FIXED CAP

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The packaging for prescription medications has not changed much over the years. However, the labeling requirements for prescriptions have grown more complex, leading to potentially significant confusion by consumers. Problems related to prescription bottle labeling, and pharmaceutical product labeling in general, are well known and have been documented extensively. In general terms, the root cause of these problems is the large amount of information required to be displayed in a very small area. This information includes patient data, pharmacy data, prescription data, physician data, cautionary data, drug information, pharmacy marketing information, required government warnings, legal disclaimers, dosage instructions, etc. So much data is required that pharmacies must also include additional printed, folded sheets of "drug facts" as part of the prescription package handed to the consumer. The challenge has been to include as much relevant information on the prescription bottle itself such that critical information stays with the medication, while keeping the bottles relatively inexpensive and keeping the labeling process efficient for a pharmacist.

Pharmacy medication bottles are inconsistent from one manufacturer to another and from one retailer to another. Prescription bottles are also labeled inconsistently from one pharmacy to another. In any given household, multiple users may have multiple prescriptions from multiple pharmacies. All of the conflicting labeling standards leave the consumer to hunt for the correct information on each bottle from each different pharmacy. In addition, the small print sizes usually found on round cylindrical bottles greatly increases difficulty of use for consumers, particularly the elderly—who often have compromised eyesight, decreased mobility, and limited tolerance for confusing labels with tiny print on a curved surface.

The label is only part of the problem. The actual geometry of prescription bottles exacerbates the issues. Bottles must be picked up while simultaneously rotated to be read clearly. They are difficult to open and fall over easily. For cylindrical style pill bottles and other prescription bottles with a typical "neck with round cap" opening, it can be difficult to remove just one pill at a time. These traditional pill bottle shapes often force the contents to be "dumped into hand" to remove a single pill, which causes spillage. Larger pills make the problems even worse, as these pills can get stuck inside the bottle and must be removed with a finger . . . and it must be a finger that does NOT have arthritis or other injuries. In the case of certain bottle shapes, particularly bottles similar to those depicted in U.S. Pat. No. 7,413,082, by Adler, and U.S. Pat. No. 8,458,994, by Guschke, the pills can become stuck or jammed into the tight corners of the bottle. Removing stuck pills becomes a major difficulty for elderly users who have no good option to dislodge the pills (e.g. shaking causes spills, a small knife damages pills, a single finger cannot quite reach, etc.), or worse, they simply lose the medication altogether.

Finally, and most importantly, current pill bottles are difficult to manage from a manufacturing and distribution standpoint. Most pharmacy bottles are merely dumped into a box or bag for shipment to local pharmacies and do not nest (or stack) easily for volume shipments at the wholesale level. Some large volume retail pharmacies regularly dispense over 2000 prescriptions in a single day. Mail order pharmacies can dispense tens of thousands of bottles daily. Bottle management, shipping, and storage have become notable and significant problems in the pharmacy industry. In addition, cylindrical bottles require different caps for each bottle size, requiring extra inventory management and storage. Existing pill bottle containers are not designed to nest together efficiently for shipment. Some slightly tapered cylindrical pill bottle shapes are capable of very limited nesting, although when forced into this configuration, the arrangement often creates unwanted suction that can stick the bottles together so tightly that they must be disposed of altogether. If all of this wasn't problem enough, many of the more complex flat sided bottles shapes (see, e.g., U.S. Pat. No. 7,413,082 by Adler; U.S. Pat. No. 8,814,216 by Estep; and U.S. Pat. No. 4,881,648 by Hagerty) require a far more expensive "blown" molding process for manufacture rather than simple injection molding. It is well known that several large retail chains in the United States each dispense over one (1) billion prescriptions per year, per retail chain. With bottle volumes in the billions, these distribution and manufacturing issues, when taken together, translate into tens of millions of dollars in extra expense per drugstore chain. The difficulty is how to create a user-friendly bottle which is also inexpensive at the wholesale level. Simple injection molding can cost one-half to one-fifth the cost of more complicated designs, with shipping, storing, and labeling efficiencies creating additional benefits.

SUMMARY OF THE INVENTION

The present invention is directed towards a novel medication container and associated labeling system, as well as an improved nesting and stacking system for the novel medication container. The invention relates primarily to over-the-counter medication containers and pharmacy prescription bottle systems, wherein the invention optimizes the correct balance of three primary criteria: 1) maximizing the flat, readable surface area of a container to allow viewing of critical information contained on the container's label, from multiple angles; 2) optimizing costs related to container manufacturing, distribution, and in-store container filling, assembly, and labeling; and 3) promoting quick medication identification, despite the existence of multiple similar containers in the same general location within the home.

In one embodiment of the invention, the container comprises a multi-faceted two-part container assembly. At a high level, the novel assembled medication container is comprised of a bathtub portion and cap portion. The overall assembly is multi-faceted, with at least six generally planar surfaces and a curved surface. The cap portion further comprises a hinged lid portion that opens and closes, allowing access to the contents within the container, in a novel manner from prior pill bottle systems.

The overall container shape can summarily be described as a flattened or truncated pyramid shape. When taken together, these seven surfaces maximize the surface area that can be used for medication information, versus traditional bottle shapes, while simultaneously creating significant volume within the container for various pill sizes.

In addition, nubs and depressions are present on the top and bottom of the assembled container to allow for nesting of disassembled top and bottom container parts, during shipment and storage. These nubs/depressions advantageously promote convenient stacking of multiple containers by pharmacists and end users, as well.

Further, the shape of the assembled container allows for multiple labeling options, including the use of a single, continuous feed label, printed via a small receipt style printer, commonly referred to as a "zebra printer". This type of label may be affixed to the container as a continuous label, and negates the need for complex adhesive die cut label sheets.

As an added benefit, manufacturing costs to produce the novel medication container are reduced, in comparison with prior pill bottle designs. The disclosed container may be made by way of the cost effective injection molded manufacturing process, generating significant savings over the traditional (and more costly) blown-molding process.

Finally, by using the same basic seven surface design, multiple container sizes can utilize a single size cap portion, and can also use the same label stock, simplifying inventory management. Once the two part container has been assembled for retail purchase, multiple containers may be stacked by the consumer into a stable arrangement that is easily viewable and will not fall over. The planar facets of the assembled container interact with the label, allowing the stacked arrangement of containers to contain consistently located information that is easy to read from multiple directions with no handling or rotation required by the consumer.

DETAILED DESCRIPTION OF THE INVENTION

In the following detailed description, reference is made to the accompanying drawings, which form a part hereof, and in which is shown by way of illustration specific embodiments in which the invention may be practiced. In this regard, directional terminology, such as "top," "bottom," "left," "right," "up," "down," etc., is used with reference to the orientation of the Figure(s) being described. Because components of embodiments of the present invention can be positioned in different orientations, the directional terminology is used for illustrative purposes and is in no way limiting. It is understood that other embodiments may be utilized and structural or logical changes may be made without departing from the scope of the present invention. The following detailed description, therefore, is not to be taken in a limiting sense, and the scope of the present invention is defined by the appended claims.

Embodiments of the invention are directed to a multi-use container system, or "pill bottle," that enhances the experience of the consumer while also minimizing costs for the retailer or manufacturer. The container system is provided primarily for use in dispensing pills (or other dry, solid contents) and is generally directed towards pharmacy prescription bottle systems as well as common over-the-counter ("OTC") medications. The contents of the container system, in solid form, will be referred to herein, for convenience and brevity, as "pills." It will be understood, however, that the concepts forming the basis of the invention can also be applied to medications in non-solid forms, such as liquids, ointments, gels, small tubes, or capsules; or even applied to similar sized contents that are not pharmaceutical in nature (e.g., small candy, breath mints, specialized fasteners and nuts, small watch batteries, etc.) as the invention is equally practicable for these items.

The descriptions below refer to both "labeled" and "unlabeled" embodiments of the invention. As used herein, the term "labeled" refers to those embodiments of the invention where information is printed onto a separate label where such label is adhered to a container as part of the final assembly, such as would commonly occur in a retail pharmacy location. Alternatively, the terms "unlabeled" or "without a label" refer to those embodiments of the invention where no label has been adhered to the container as part of the final assembly. For convenience and brevity, it is assumed that the term "labeled" will also include those embodiments where printed information may be permanently transferred directly onto the container itself by any practical means such as inkjet printing, heat transfers, laser etching, silk screening, or any other method of permanently marking information onto the container in a similar fashion as to the "labeled" illustrations shown herein.

Figure 1:
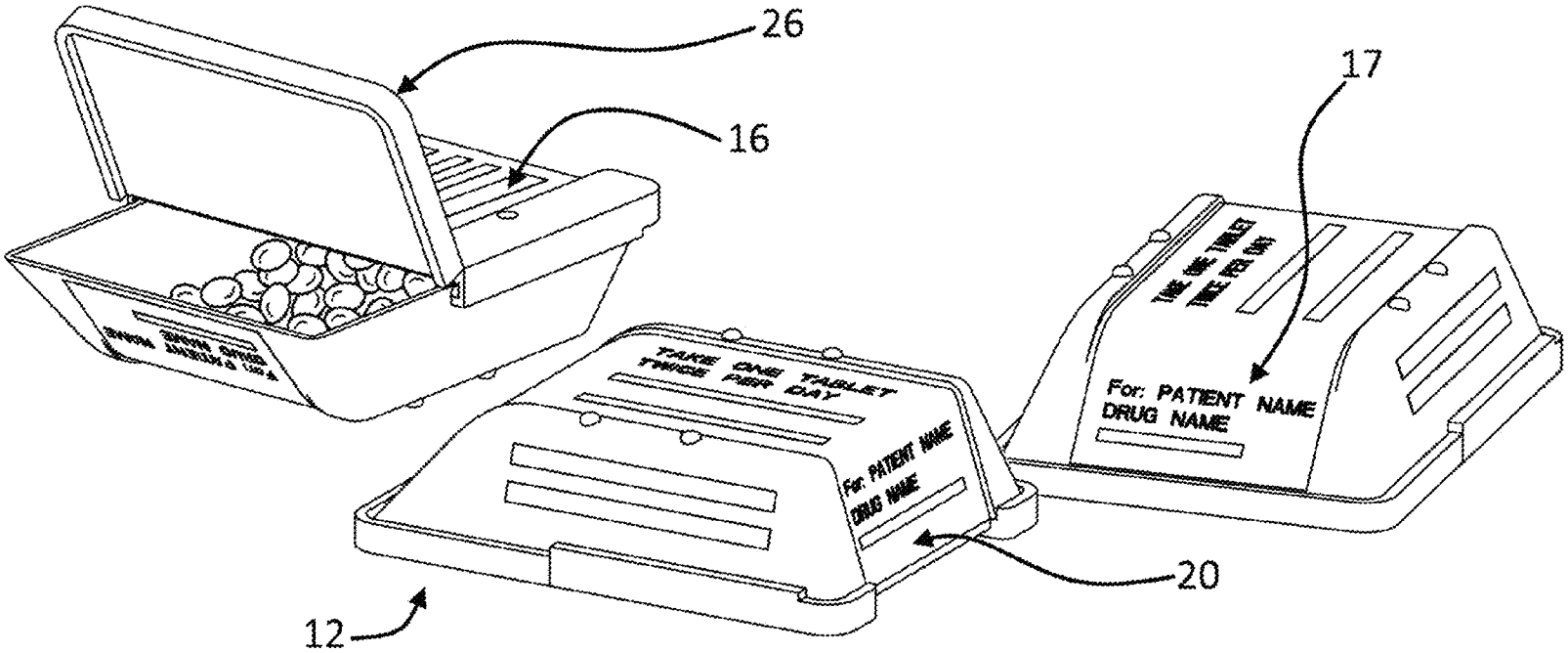
FIG. 1 is a schematic illustration, including isometric views of a plurality of labeled containers resting on a support surface, according to an embodiment of the invention.

Referring now to a labeled embodiment of the invention, FIG. 1 represents a single assembled and labeled two-part medication container 12, displayed from three different views. The two-part assembled container is of a generally pyramidal shape, and is represented by front, rear, and inverted isometric views. FIG. 1 demonstrates how the novel pyramidal shaped medication container may be viewed and used by a consumer. This labeled container assembly offers several benefits over prior medication bottles, as described in the Summary of the Invention section. The components and construction details of container 12 will be described in detail later in the specification.

Figure 2A:
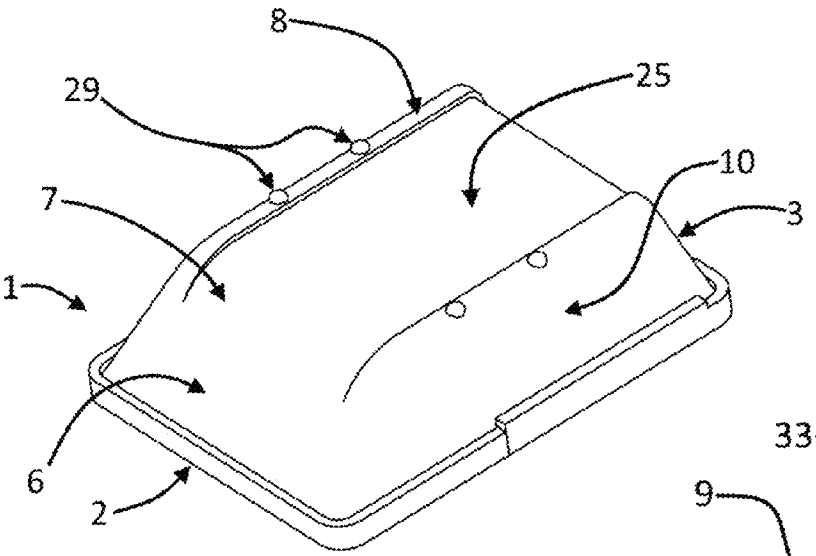
FIG. 2A is a top front isometric view of an assembled container without labels, according to an embodiment of the invention.
Figure 2B:
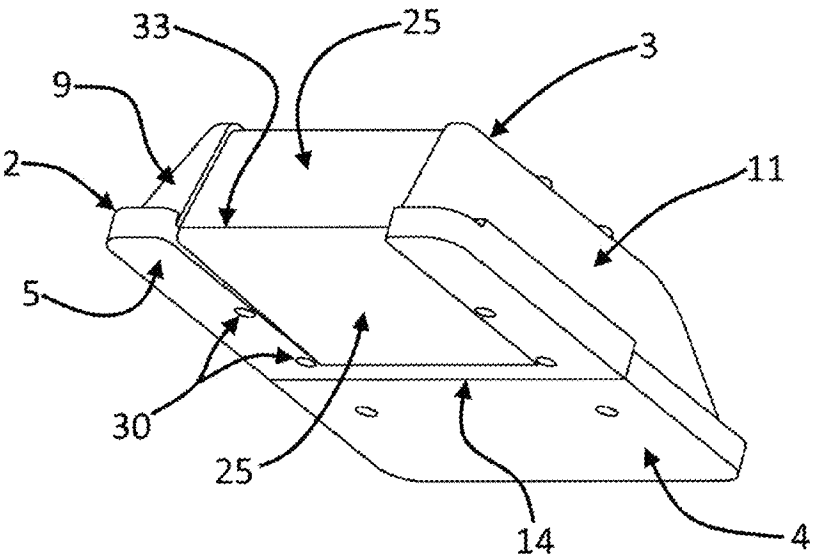
FIG. 2B is a bottom rear isometric view thereof.

Referring now to FIG. 2A and FIG. 2B, these two figures represent a basic unlabeled embodiment of the invention. FIG. 2A is a top front isometric view of the two-part assembled container 1, and FIG. 2B is a bottom rear isometric view of the same container 1. In this basic embodiment, assembled container 1 comprises a cap portion 2 and a bathtub portion 3. Cap portion 2 comprises a generally planar bottom face 5 that forms the bottom of said container 1. The cap portion 2 further comprises an integrated hinged lid portion 4 that pivots on a fixed hinge 14, allowing the lid portion 4 to open and close. Bathtub portion 3 comprises at least one generally planar top face 8 that is positioned roughly parallel to and generally away from bottom face 5 of the cap portion 2. In this basic embodiment, bathtub portion 3 comprises two generally planar surfaces 6 and 9, two generally planar sides 10 and 11, and one curved section 7. Cap portion 2 contains attaching means for attaching said cap portion 2 to said bathtub portion 3. When said container 1 is disassembled, bathtub portion 3 comprises an open bottom portion of generally the same area as the area of bottom face 5 of cap portion 2.

Figure 4B:
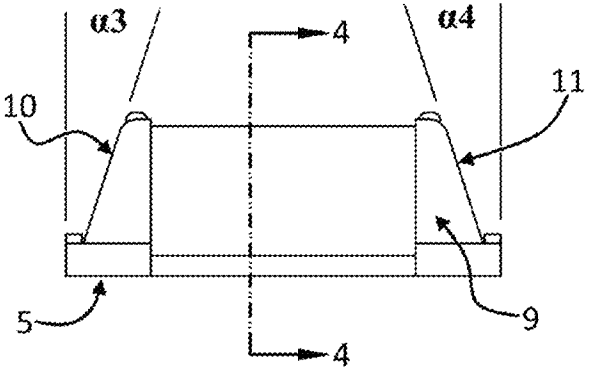
FIG. 4B is a plan view of the rear portion thereof with a longitudinal section cut 4-4, according to an embodiment of the invention.
Figure 4D:
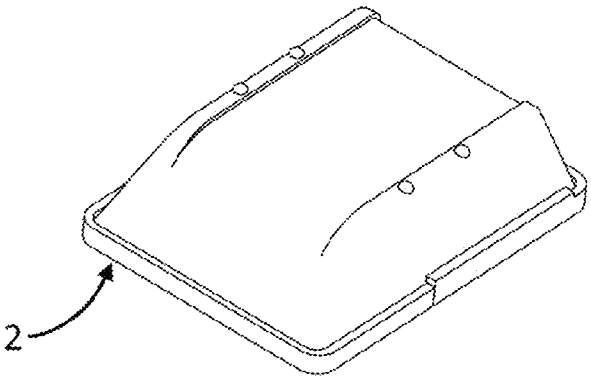
FIG. 4D is a top front isometric view thereof.
Figure 4A:
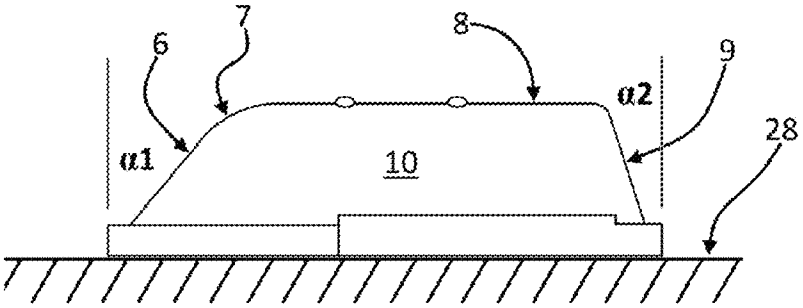
FIG. 4A is a plan view of the side portion of the container without labels, resting on a support surface, according to an embodiment of the invention.

Referring to FIGS. 2A and 2B in more detail, the front and back faces 6 and 9 of the bathtub portion 3 extend generally away from a vertical extending down towards the bottom edge of front face 6 and back face 9, as depicted in FIG. 4A. Sides 10 and 11 extend away from a vertical extending down towards the bottom edge of each of sides 10 and 11, as depicted in FIG. 4B. Sides 10 and 11 connect the front face 6, curved section 7, top face 8, rear face 9, and bottom face 5, of the container 1. In general, the overall assembled container shape can summarily be described as a flattened or truncated pyramid shape.

FIGS. 2A and 2B show top front and bottom rear isometric views of the assembled container prior to labeling of container 1. In both figures, label placement guide 25 is comprised of depressed rectangular section on both the bathtub portion 3 and cap portion 2 of said container 1, which appears (when said container is assembled) to extend around the bathtub portion 3 from front face 6 around the top face 8 and over rear face 9 onto the bottom of cap portion 2, to facilitate correct label placement on container 1. In addition, a series of protrusions (or "nubs") 29 are located on the top face 8 of container 1, and a series of depressions 30 are located on the bottom face 5 of cap portion 2.

In this embodiment, four individual nubs 29 on the top face 8 of the container are designed to fit easily into four depressions 30 on the bottom face 5 of an assembled container 1. Viable stacking arrangements for the assembled container 1 are described in detail later in the specification.

Figure 3A:
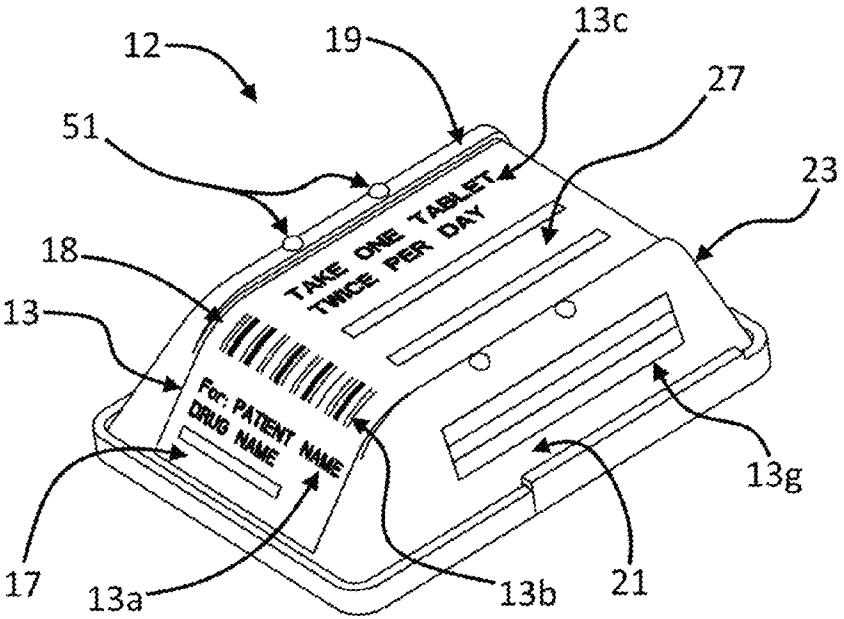
FIG. 3A is a top front isometric view of an assembled container with labels, according to an embodiment of the invention.
Figure 3B:
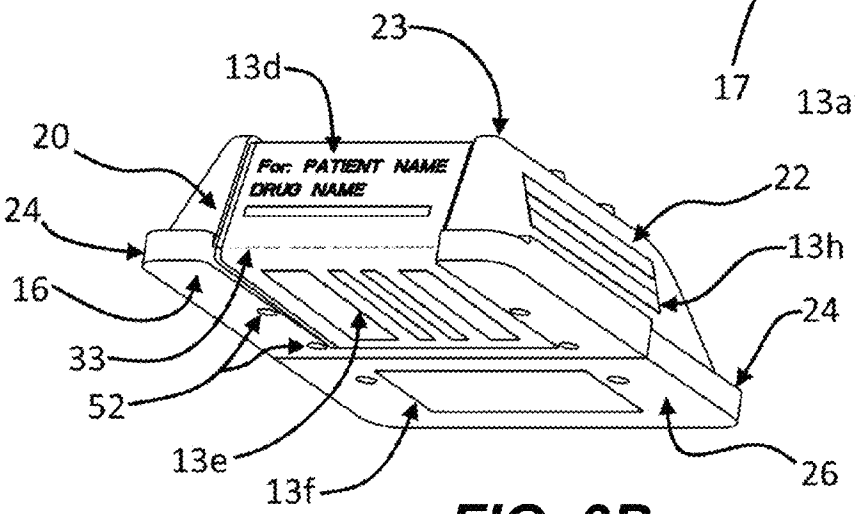
FIG. 3B is a bottom rear isometric view thereof.

A labeled embodiment of the invention is depicted in FIGS. 3A to 3B. In this embodiment, the assembled container 12 is identical to container 1 in FIGS. 2A-2B, but further comprises a label portion 13. Components 2, 3, 4, 5, 6, 7, 8, 9, 10, 11, and 25 from the first unlabeled embodiment have been renumbered as components 24, 23, 26, 16, 17, 18, 19, 20, 21, 22, and 27, respectively, in FIGS. 3A-3B. Components 29 and 30 from FIGS. 2A-2B have been renumbered as components 51 and 52 in FIGS. 3A-3B.

Figure 10:
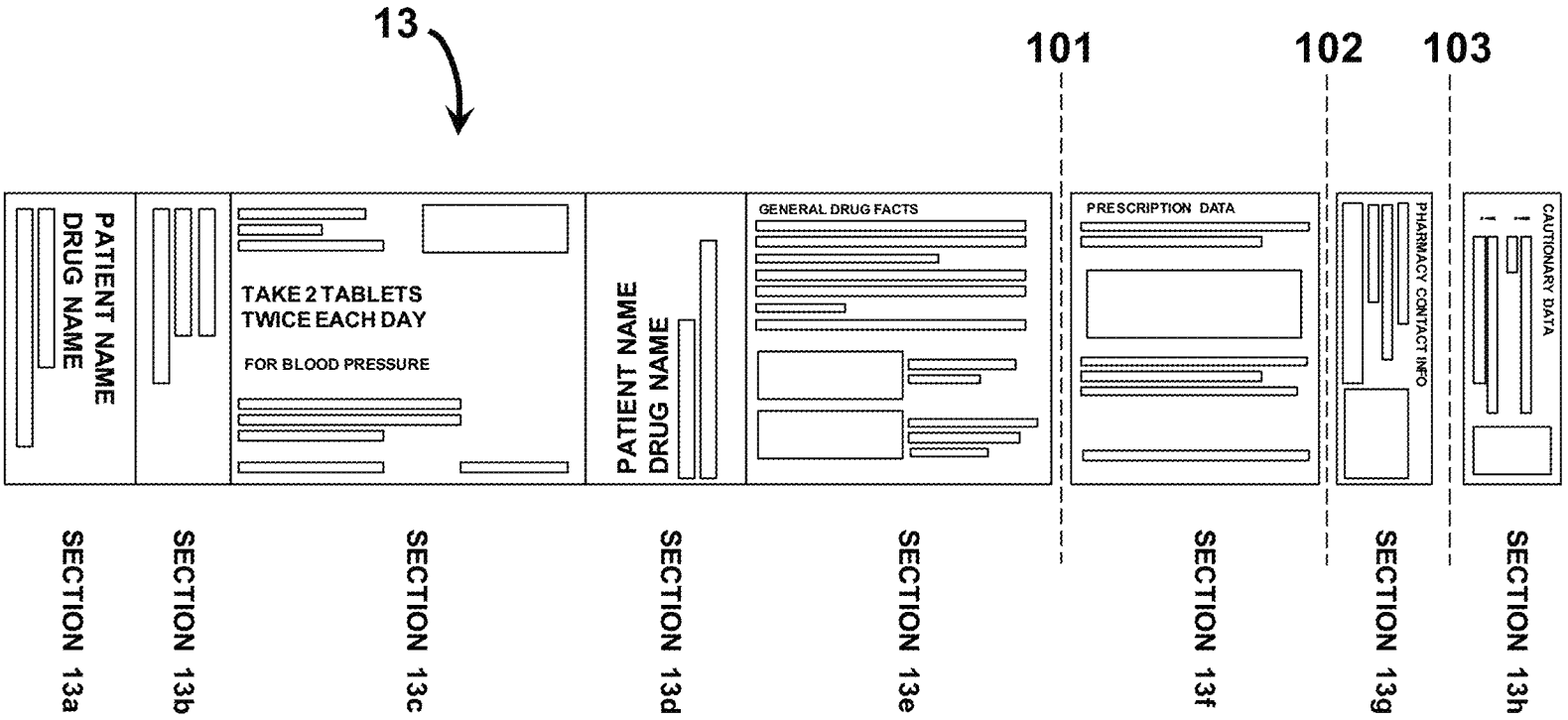
FIG. 10 is a block diagram of a label in a flat configuration showing proper text orientation according to an embodiment of the invention.

In the first labeled embodiment of the invention, label portion 13 is made up of a continuous label of eight label sections 13*a*-13*h*, represented in FIG. 10. Sections 13*g* and 13*h* are affixed, respectively, to sides 21 and 22 of container 12. Section 131 is attached to the hinged lid portion 26 of cap portion 24. Next, section 13*a* is affixed to the front face 17 of the bathtub portion 23, and the remaining sections 13*b*, 13*c*, 13*d*, and 13*e* are wrapped around the container and affixed to the curved section 18, top face 19, rear face 20, and bottom face 16. As such, seven surfaces of container 12 are optimally used to display the information printed on the eight label sections of label portion 13.

This label assembly offers the advantages of secure assembly and tamper resistance. When sections 13*a*-13*e* of label portion 13 are wrapped 360 degrees around the assembled bathtub portion 23 and cap portion 24, label portion 13 secures the bathtub portion 23 and cap portion 24 at the rear seam 33, further adhering the cap portion 24 and bathtub portion 23 into a permanent assembly. Once assembled, container 12 is not meant to be disassembled by the consumer, without special tools. Further, once sections 13*a*-13*e* are secured to the container 12, label portion 13 assists in holding the cap portion 24 and bathtub portion 23 of the container 12 together, adding the additional feature of tamper resistance. In this preferred embodiment, the shape of container 12 allows a single, continuous feed label to be printed via a small receipt style printer, commonly referred to as a "zebra printer," negating the need for complex adhesive die cut label sheets.

While the preferred embodiment demonstrated in FIGS. 3A-3B shows eight label sections affixed to seven surfaces, it is contemplated that the label portion 13 may be comprised of fewer label sections affixed to fewer surfaces on assembled container 12, as long as a user can easily read printed label information on the front face 17 and rear face 20 of each container 12, when multiple assembled containers 12 are stacked.

Construction Details of the Invention

Referring now to the construction details of the invention, as depicted in FIGS. 2A to 3B, the bathtub portions 3 and 23, and cap portions 2 and 24, may be made of any combination of plastic materials commonly used in the prescription bottle manufacturing process, included but not limited to those known in the art of pill bottle manufacturing. Furthermore, the container parts may be manufactured via the cost effective injection molding process, or blown-molding process, although this latter process is more costly. It is also contemplated that other processes commonly used in the art bottle manufacturing may also be used.

Referring to FIGS. 3A-3B, label portion 13 may be made of traditional label components used in the art, including but not limited to white label sticker material composed of paper and adhesive, made by manufacturers such as Avery Dennison and the like. It is contemplated that the label depicted in FIG. 10 may be printed using receipt-style or "zebra" printers. However, any other label printer types that are traditionally used in the pharmacy/medical field may also be used to produce labels for the container depicted in FIGS. 2A-3B. One example of such other methods would include, but not be limited to, the printing method used to produce die-cut label sheets.

DESCRIPTION OF REMAINING FIGURES

Referring again to FIG. 1, this figure represents the same labeled embodiment of the invention depicted in FIGS. 3A-3B. In detail, FIG. 1 depicts a plurality of labeled containers 12 arranged on a support surface (e.g. a tabletop), in various orientations. On the right, assembled container 12 is shown from the perspective of a viewer facing toward the front angled face 17; in the middle, assembled container 12 is shown from the perspective of a viewer facing the side 21 and rear angled face 20. On the left, assembled container 12 is shown in an inverted position, with the integrated hinged portion 26 of bottom face 16 in the open position, with a user ready to access the contents inside the container 12, shown here as pills. The labeled container 12 displays the drug name and patient name in a redundant fashion on both the front surface 17 and the rear surface 20, along with other less prominent information on these surfaces. This arrangement of redundant information on the front face 17 and rear face 20 of the container 12 allows the most critical medication information to be read from multiple directions, whether the container is oriented frontwards or backwards relative to the person viewing the container.

The front face 17 of the container 12 is designed such that this angled surface can be easily read when positioned directly at a viewer's eye level (e.g. while in a cabinet), or when a viewer is positioned above containers stacked on a countertop or table (e.g. by the bathroom sink, or kitchen countertop). FIG. 4A shows a side view of the unlabeled assembled container 1, sitting on a support surface 28. The angle of the front face 6 as measured from a hypothetical vertical axis would generally range from 10 degrees to 60 degrees. This angle range, as noted by angle $\alpha$1 in FIG. 4A, is designed for optimal viewing of the label face, once a label portion is added to the container, while the container is resting on a countertop.

Similarly, the angle range of rear face 9 is depicted by angle $\alpha$2 in FIG. 4A, and may generally range from 0 to 45 degrees, as measured from a hypothetical vertical axis. The preferred embodiment has the front angle $\alpha$1 at 40 degrees in all figures attached hereto, although alternative embodiments would include a container in which the front face 6 and rear surface 9 are angled identically, which is an equally viable configuration.

The angle range of sides 10 and 11, are depicted by $\alpha$3 and $\alpha$4 in FIG. 4B, and may generally range from 0 to 45 degrees, as measured from hypothetical vertical axis. In the preferred embodiment of the invention, these angles are equal. The specific angle configurations listed above for the preferred embodiments of the invention are in no way limiting, as the general angle ranges listed above for $\alpha$1, $\alpha$2, $\alpha$3, and $\alpha$4 are contemplated for various embodiments of the invention.

Figure 4C:
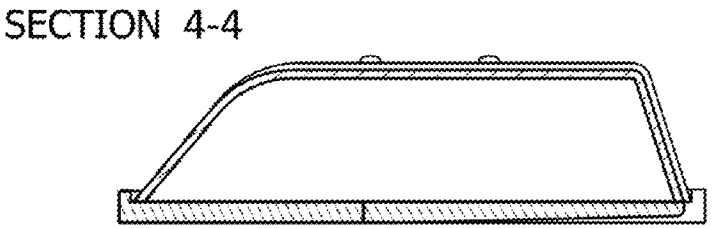
FIG. 4C is a cross sectional side view thereof for Section 4-4, according to an embodiment of the invention.

FIG. 4C represents a cross sectional side view of unlabeled container 1. FIG. 4D represents a top front isometric view of container 1, including cap portion 2.

A side view, rear view and cross sectional view of the preferred embodiment of container 12 are not specifically shown in the drawings, but it is noted that container 12 would have all the same features as unlabeled container 1, as depicted in FIGS. 4A-4D, including the general angle ranges described above for container 1. A label portion would also be attached to the container.

Advantages of Larger Label Surface and Multi-Faceted Container Shape

The invention offers a significant improvement over existing medicine container designs in several ways including: A) as shown in the preferred embodiment of container 12 in FIGS. 3A and 3B container 12 rests on the largest bottom face 16 of cap portion 24, which in conjunction with the low profile pyramidal shaped design creates a highly stable platform not prone to falling over; B) container 12 has sufficient surface area to allow at least some redundant information on opposite faces of the container 17 and 20, thus allowing critical prescription information to be read from the front or rear without the need of a user to handle the container 12; C) the angled front face 17 of container 12, containing large print, allows a user to easily identify the medication without having to pick it up from a countertop to read it; D) the wide bottom face 16 of cap portion 24 becomes a large additional surface for printed prescription information not available on other containers; and E) the stable, wide based cap portion 24 of container 12 allows the introduction of "angled stacking" to easily store multiple medications together in logical arrangements while maintaining high stability, all while allowing readability of multiple container labels from multiple directions, as further described below.

As depicted in the various embodiments of the invention (FIGS. 1-4D), when the container is placed onto any surface (e.g. countertop, cabinet shelf), it will remain upright despite continued jostling and interaction with other items which may be regularly accessed on the surface nearby (e.g. other items in the medicine cabinet, a hairbrush on the countertop). Historically, prescription bottles fall over when upright, which requires them to be picked up by the user and handled for identification. This has become a very common problem with existing cylindrical pill bottles and other "top heavy" designs which often utilize the smallest bottle surface as the primary support for the container. For the descriptions herein, "upright" is meant to define the bottle orientation where labels and text are most easily read by the user. Many existing designs (see U.S. Pat. No. 7,413,082 by Adler; U.S. Patent No. 2013/0320017A1 by Kientzle, U.S. Pat. No. 8,359,816 by Gushke) are often top-heavy when upright and filled with pills. The bottle and its contents become balanced on the smallest surface of the container when upright, encouraging the bottle to topple over when jostled or bumped. Once toppled, the most critical information on the bottle often becomes obscured until the bottle is picked up. In the present invention, the container rests on the largest surface, the bottom face of the cap portion. This large bottom surface has a low profile for maximum stability. Of further benefit, a natural pyramid shape cannot "fall over" even when bumped. For example, when a label portion is affixed to the front and rear faces of the bathtub portion of the container, the important information on the label portion becomes easily read and identified from multiple directions at all times.

Viable Container Stacking Arrangements

Figure 5:
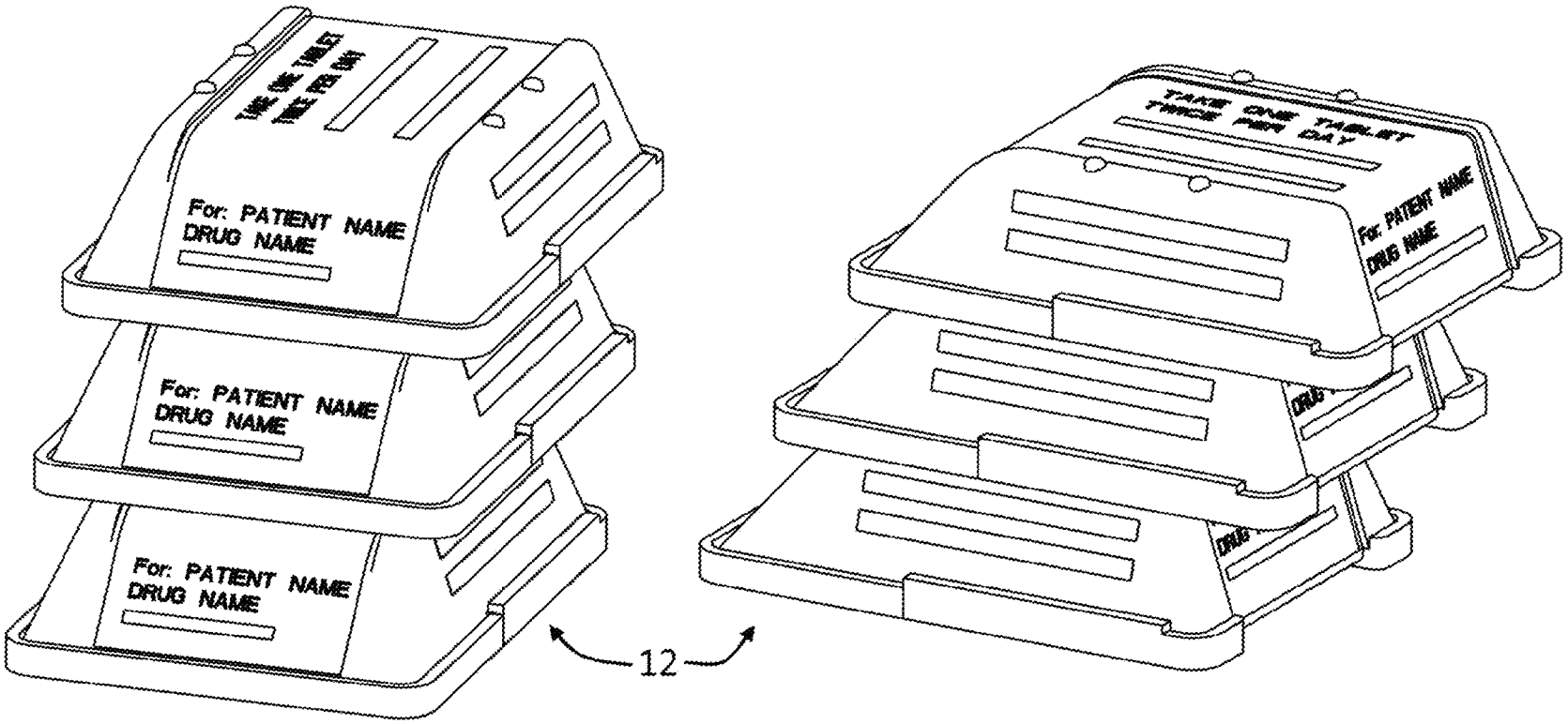
FIG. 5 is a schematic illustration of a plurality of labeled containers arranged on a support surface, including isometric views of two groups of containers in the FRONTWARDS stacking arrangement, according to an embodiment of the invention.
Figure 6:
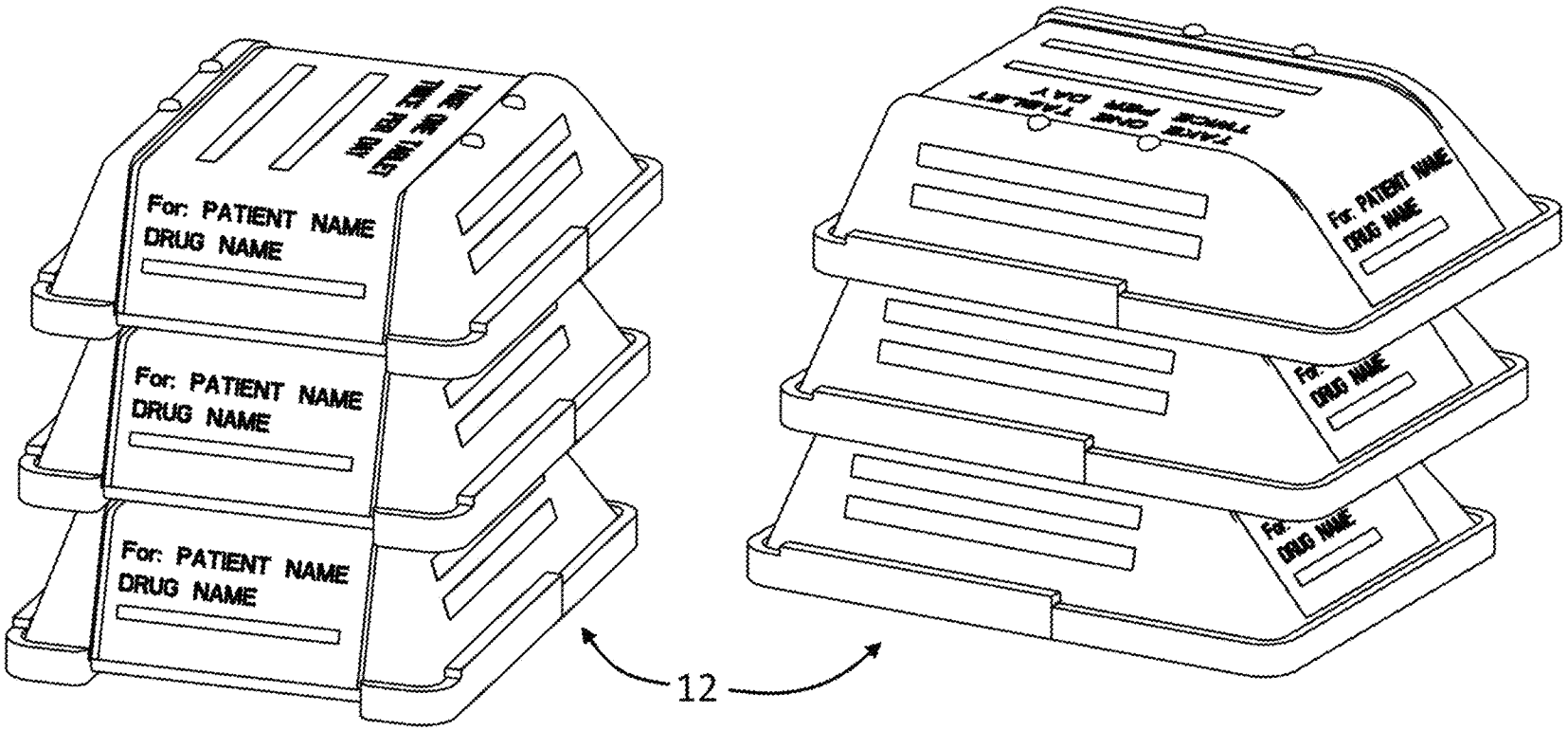
FIG. 6 is a schematic illustration of a plurality of labeled containers arranged on a support surface, including isometric views of two groups of containers in the REARWARDS stacking arrangement, according to an embodiment of the invention.

FIG. 5 shows an embodiment of the invention, as a plurality of assembled containers 12 stacked into two separate groupings. This arrangement, where the containers are stacked such that the front face 17 of each container remains visible while at counter height is known as a "frontwards stack." This stacking arrangement is based upon the front angled surface of the container, and the stacked group of containers will slant as shown, obscuring the rear surfaces of the lower containers in the stack. Similarly, FIG. 6 shows the same containers stacked such that the rear face 20 of each container remains visible, with the stacking angle based upon the angle of the rear face 20 of the container. This is known as a "rearwards stack" and this stacking arrangement will obscure the front face 17 of the lower containers in the stack as shown. Either stacking arrangement allows the front faces 17 (for a frontwards stack) or rear faces 20 (for a rearwards stack) of each container in the stack to be clearly viewed while at eye level as shown in the front view FIG. 8A.

Figure 7:
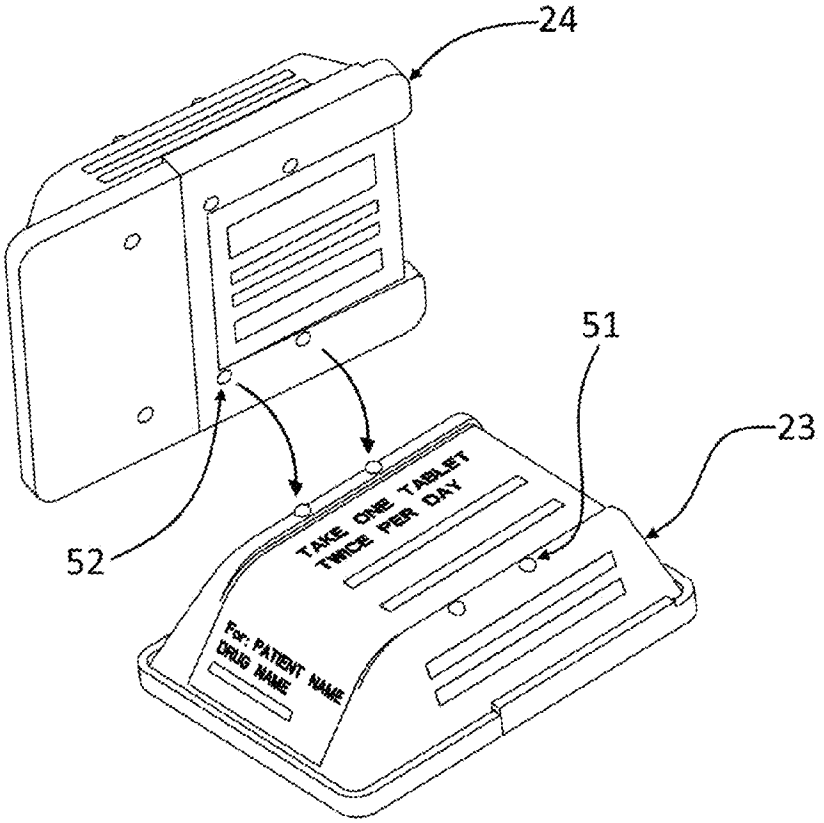
FIG. 7 is an exploded view of the labeled containers illustrating proper placement for the REARWARDS stacking arrangement.

To accomplish the stacking arrangements, FIG. 7 shows that the top surface of the preferred embodiment of the container 12 incorporates nubs or protrusions 51 which mate into similar depressions 52 on the cap portion 24 of the next container 12, thus allowing multiple containers to firmly mate into place when these components are aligned as indicated by the two arrows in FIG. 7. The nubs 51 are placed such that the containers 12 will stack at the proper angle and not slide once stacked. Contemplated embodiments of the invention comprise several styles of continuous or individual nubs. However, the preferred embodiment shown in FIG. 7 shows four individual nubs 51 on the top face of bathtub portion 23 of a container 12, which are arranged to fit easily into the depressions 52 on the bottom cap portion 24 of another container 12. In this embodiment, the containers 12 to be stacked each contain a label portion 13. However, similar mating arrangements of nubs and depressions on alternate embodiments of the invention are contemplated as well. For example, assembled container 1 (as depicted in FIGS. 2A-2B), could also be stacked by mating four nubs 29 of container 1 with the depressions 30 of a second container 1, for instance by a pharmacist, prior to labeling the containers.

Figure 8B:
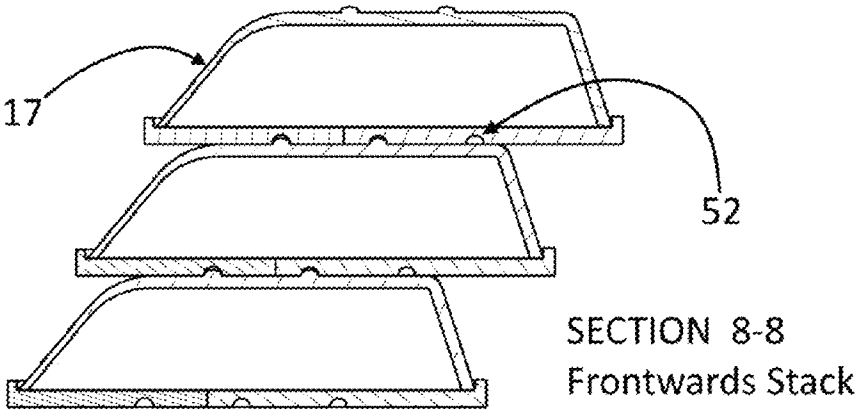
FIG. 8B is a cross sectional side view thereof for Section 6-6 while the containers are in a FRONTWARDS stacking arrangement.
Figure 8C:
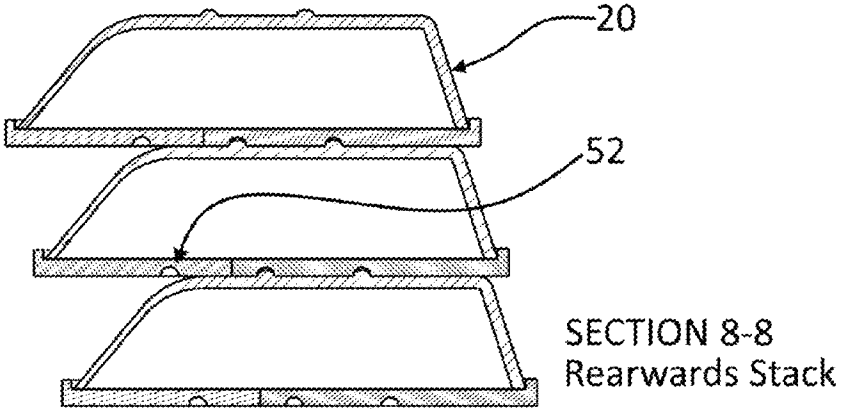
FIG. 8C is a cross sectional side view thereof for Section 6-6 while the containers are in a REARWARDS stacking arrangement.
Figure 8A:
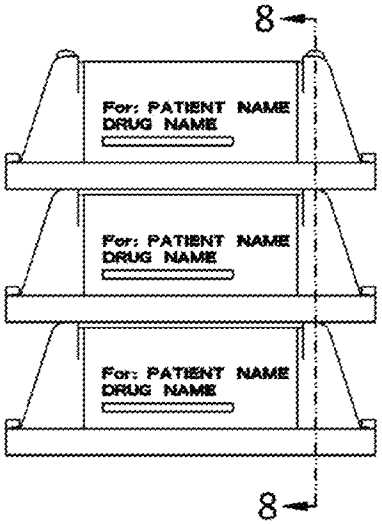
FIG. 8A is a plan view of the front portion of the labeled containers in a stacked arrangement, with a longitudinal section cut 6-6 according to an embodiment of the invention.

In FIG. 7, cap portion 24 comprises multiple sets of depressions 52, which allows the four nubs 51 to mate with the depressions 52 on each container 12 in such a way that the containers can be stacked frontwards as shown in FIG. 8B, based upon the angle of the front face 17 of the container, or backwards as shown in FIG. 8C based upon the rear face 20 of the container. For either stacked arrangement, at least one set of two depressions 52 remain unused, as shown in the cross section views FIG. 8B and FIG. 8C. The front face 17 or rear angled face 20 remains clearly visible when multiple containers are stacked either at eye level or at countertop level.

This preferred embodiment of a stacked container system is designed in such a way that at least three (3) full containers can be stacked together, with the arrangement remaining completely stable. Additional containers may also be stacked at any time, but stability will depend on the weight of the contents within and whether they are stacked frontwards or rearwards.

Although the FRONTWARDS and REARWARDS stacking arrangements disclosed above in FIGS. 5-8C are for the labeled embodiment of the invention, as disclosed in FIGS. 3A-3B, unlabeled embodiments of the invention (as disclosed in FIGS. 2A-2B and FIGS. 4A-4D) or alternatively labeled containers (e.g. through printing of information directly onto said unlabeled containers, or via labeling using die-cut sheets) may be also be stacked according the disclosed stacking methods described above.

Advantages of Disclosed Stacking Methods

This stable stacking arrangement is an improvement over other stackable designs (such as U.S. Pat. No. 8,814,216, by Estep) which would become inherently unstable and prone to toppling if even two full bottles were stacked together. In addition, the Estep arrangement does not incorporate angled faces or angled stacking arrangements, making the Estep bottle more difficult to read if stacked while on a countertop, unless the reader is bending over to see it. Therefore, the low-profile pyramid shaped design of the disclosed invention remains stable, easily viewable, and will not topple unless at least four or more containers are stacked.

This unique angled stacking concept provides several enhanced consumer benefits which can be chosen at the discretion of the end user or retail pharmacy, including but not limited to: A) a stable yet compact arrangement to place a plurality of containers together in a tidy configuration for easy access, while ensuring critical prescription information remains visible and the grouping remains intact; B) multiple users within a household can each have their own individual stack, reducing confusion; C) retailers can offer users multiple bottle colors, creating an additional visual cue to the user to stack like-colored bottles together for different members of the household; D) medications can be stacked into a "morning regimen" or "evening regimen" creating additional simplicity for the user; or E) medications can be stacked by type or intended use (e.g., blood pressure medications, headache remedies). These stacking concepts may be used in conjunction with customized labeling text chosen by the retailer (e.g., additional label colors, bold label numbering on the front face, morning/evening label callouts) which would further enhance the stacking/labeling rationale for the end user, creating additional clarity and usability for consumers.

Advantages to Nub and Depression Spacing

In addition, if a retailer or manufacturer desires, the placement of nubs and depressions can be varied in several ways such that only certain bottles can be stacked together. Examples would include varying the nub/depression spacing such that certain containers, containing similar nub/depression spacing, are designated for certain uses and stacked together. Similarly, containers designated for a certain family member may have similar nub/depression spacing so that only like-type bottles can be stacked together for that family member. Although this methodology is more complex to manufacture and distribute, it creates additional enhancements which may be particularly useful to identify different classes of items such as over-the-counter ("OTC") vs. prescription medications, which logically should be stored in separate stacks.

Preferred Method of Attaching Bathtub Portion to Cap Portion of Container

Figure 9A:
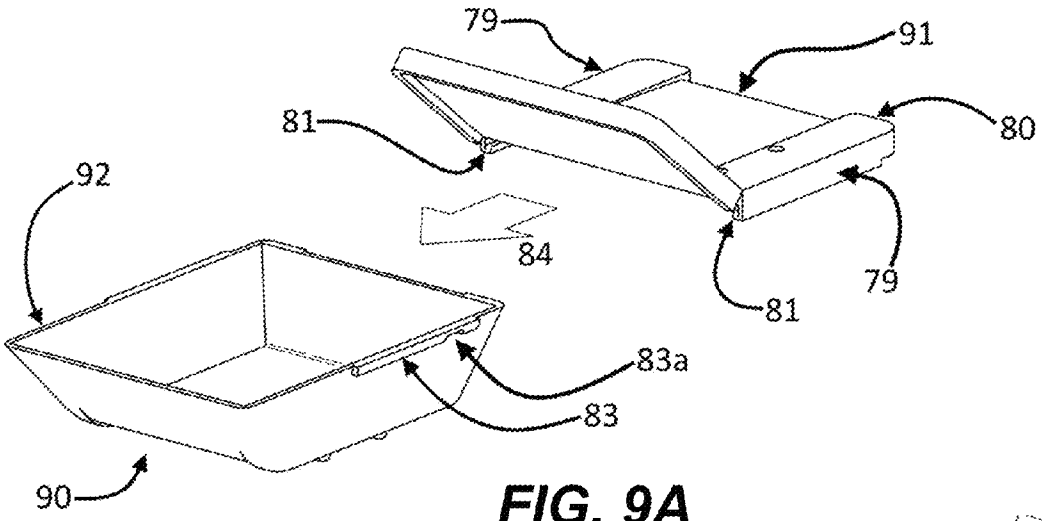
FIG. 9A is an exploded view of the container without labels illustrating proper assembly of the container, according to an embodiment of the invention.
Figure 9B:
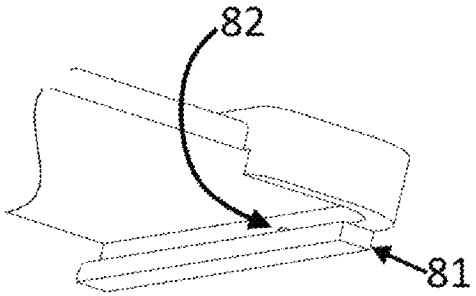
FIG. 9B is a detail view of the rear of the cap portion of the container, according to an embodiment of the invention.
Figure 9C:
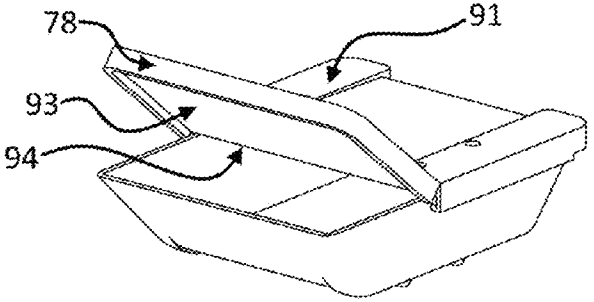
FIG. 9C is a top front isometric view of an inverted container illustrating completed assembly of the container, according to an embodiment of the invention.

Multiple attachment methods for the cap portion to bathtub portion of an unlabeled container are available based on specifics to be chosen by persons fluent in the art of bottle manufacturing and injection molding, but the primary embodiment shown in FIG. 9A allows the most straightforward method for pharmacists to assemble a container. In FIG. 9A through FIG. 9C, unlabeled container 90 is identical to the basic container 1 (depicted in FIGS. 2A-2B), but the container and its existing components have been renumbered, and additional elements have been added. In FIG. 9A, cap portion 91 of container 90 comprises front face 78, left and right sides 79, and rear face 80. In this embodiment, left and right sides 79 each further comprise side rails 81. FIG. 9B shows a close-up detail of the underside of side rail 81 showing the locking mechanism 82 molded into the side rail 81. The bathtub portion 92 in this embodiment further comprises guiderails 83 on each side of container 90. The locking mechanism 82 mates into a molded receptacle 83*a* in a guide rail 83 on the side of the bathtub portion 92. The cap portion 91 is made from a slightly flexible plastic such that when the cap portion 91 is aligned and slid into place from the rear, as indicated by the large arrow 84, the side rails deform slightly until the locking mechanism 82 reaches the receptacle 83*a*, snapping into place making the assembly relatively permanent, and the parts cannot be removed easily, without the use of special tools. At that point, the open integrated hinged lid portion 93 of the cap portion 91 is ready to be snapped shut, as shown in FIG. 9C, pivoting on the fixed hinge 94 shown in FIG. 9C. The elements described above for an unlabeled embodiment of the invention equally apply to a labeled embodiment of the invention, as described below.

Figure 11:
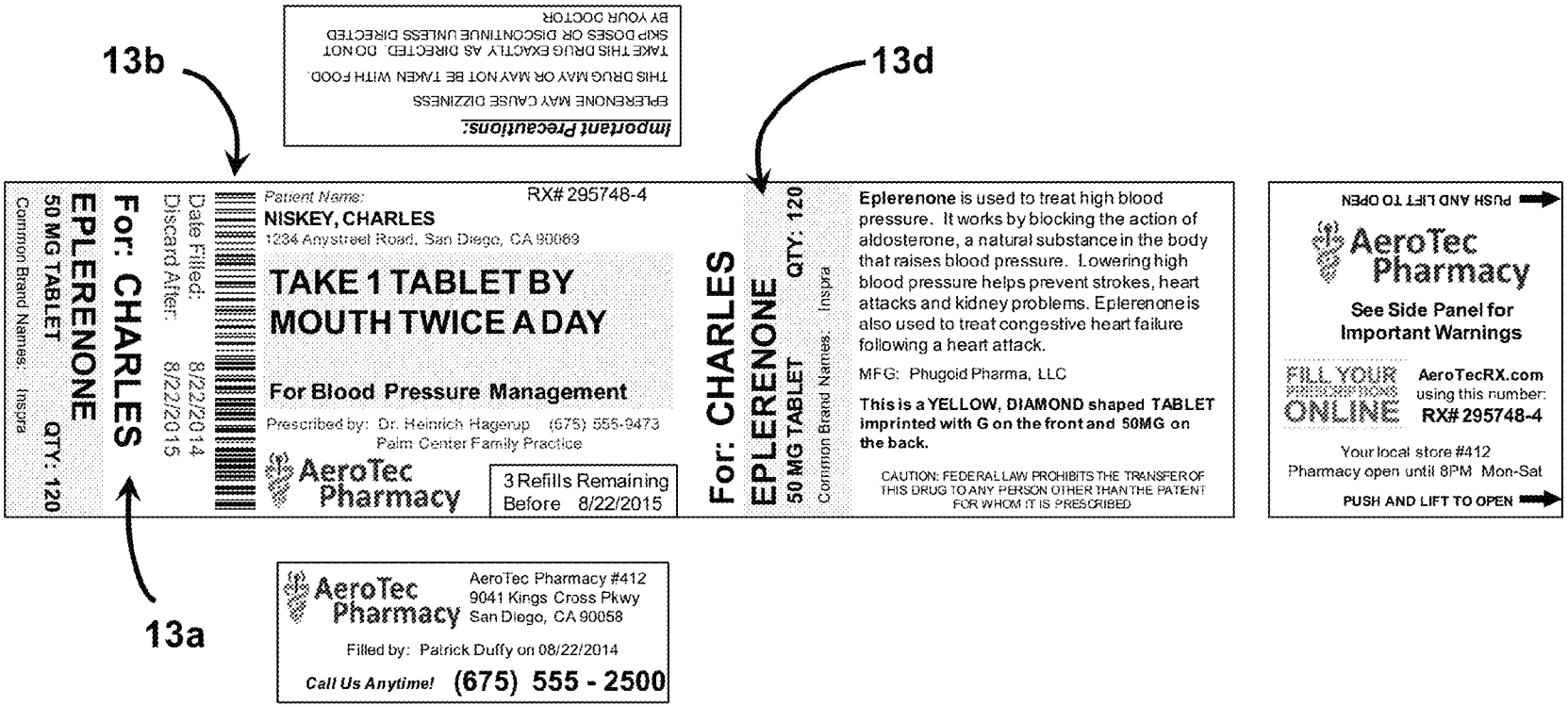
FIG. 11 is a top view of an example printed pharmacy label based on FIG. 10, in a flat configuration as it would be prior to being affixed to the container.

Once an unlabeled container has been assembled and shut, it can be labeled as desired. FIG. 10 shows one embodiment of a continuous feed adhesive label layout to be attached to a container, depicted as label portion 13. Label portion 13 has a width designed to fit closely into the label placement guide 27 of the container depicted in FIGS. 3A-3B. Label portion 13 has a length sufficient to wrap 360 degrees around a container 12 from the front face 17 to the end of the bottom face 16, as depicted in FIGS. 3A-3B. FIG. 10 shows eight discrete label sections with proper text orientation for that section of printed label, each corresponding to a unique surface of the container 12. Additional length of printed label allows the left side label section 13*g* and right side label section 13*h* to be printed on the same continuous-feed label stock. In this embodiment, a pharmacist can use three simple straight scissor cuts as shown by the dashed lines 101, 102 and 103 to detach continuous label sections 13*a* to 13*e*, hinged lid label section 131, left side label section 13*g*, and right side label section 13*h*, of label portion 13. FIG. 11 shows one example of a fully printed and cut label portion 13, for the prescription medication "Eplerenone" being prescribed to the hypothetical patient Charles Niskey. FIG. 11 illustrates typical information which may be desirable for the label portion 13, in the proper orientation required, including the redundant front face label section 13*a* and rear face label section 13*c*1. The label section 13*b*, which corresponds to the curved surface of the container 18, contains the bar code commonly used to encode important information required by the pharmacy selling the medication. Exact placement of information such as barcodes can be at the discretion of the manufacturer or pharmacy chain, as desired.

Advantages of Novel Labeling System

Figure 15:
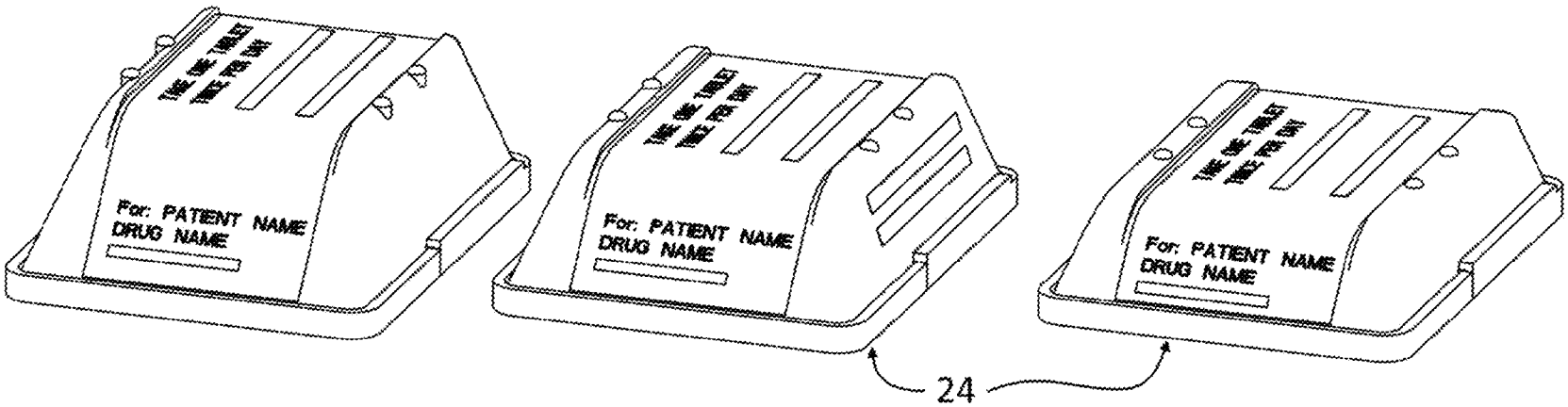
FIG. 15 is a schematic illustration, including isometric views of a plurality of labeled containers, each in a different dram size, resting on a support surface with labels, according to an embodiment of the invention.

The labeled embodiment of an assembled medication container (as displayed in FIGS. 3A-3B, and FIGS. 5-8C) is a significant departure from other bottle/container designs in use today as the label/container assembly has no wasted label stock to discard. Many adhesive pharmacy labels in use today are printed on 8.5×11 die cut sheets utilizing highly specialized adhesive geometries (see FIG. 6 of U.S. Pat. No. 7,413,082 by Adler; see FIG. 17 of U.S. Patent No. 2010/0133139A1). Although die-cut labels for pharmaceutical bottles are common, these are relatively expensive compared to continuous feed label stock, and can be wasteful as much of the label stock is discarded except for the few portions applicable to that particular bottle. Further, the primary embodiment of the label portion 13, as shown in FIG. 10 and FIG. 11, matches the container 12 geometry (as shown in FIGS. 3A-3B) to the label portion width, allowing a highly efficient use of label stock, simplified label alignment and placement, and use of identical label stock for multiple container sizes. For larger or smaller dram sizes of the disclosed container design, each container size only requires sufficient label stock to scroll out and completely wrap that particular dram size, enhancing simplicity and reducing waste as no different label stock (width) is required for different size containers. To illustrate alternate embodiments in differing dram sizes, FIG. 15 shows three separate dram sizes of container 12 resting together on a support surface. In FIG. 15, the same size cap portion 24 is used on each dram size, eliminating the need for multiple cap sizes, while the same continuous feed label stock may be used, albeit in slightly different lengths to wrap the entire container 12. In all cases, the stacking stability for at least three containers remains intact for different dram sizes, provided the user stacks larger and smaller containers appropriately.

Figure 12:
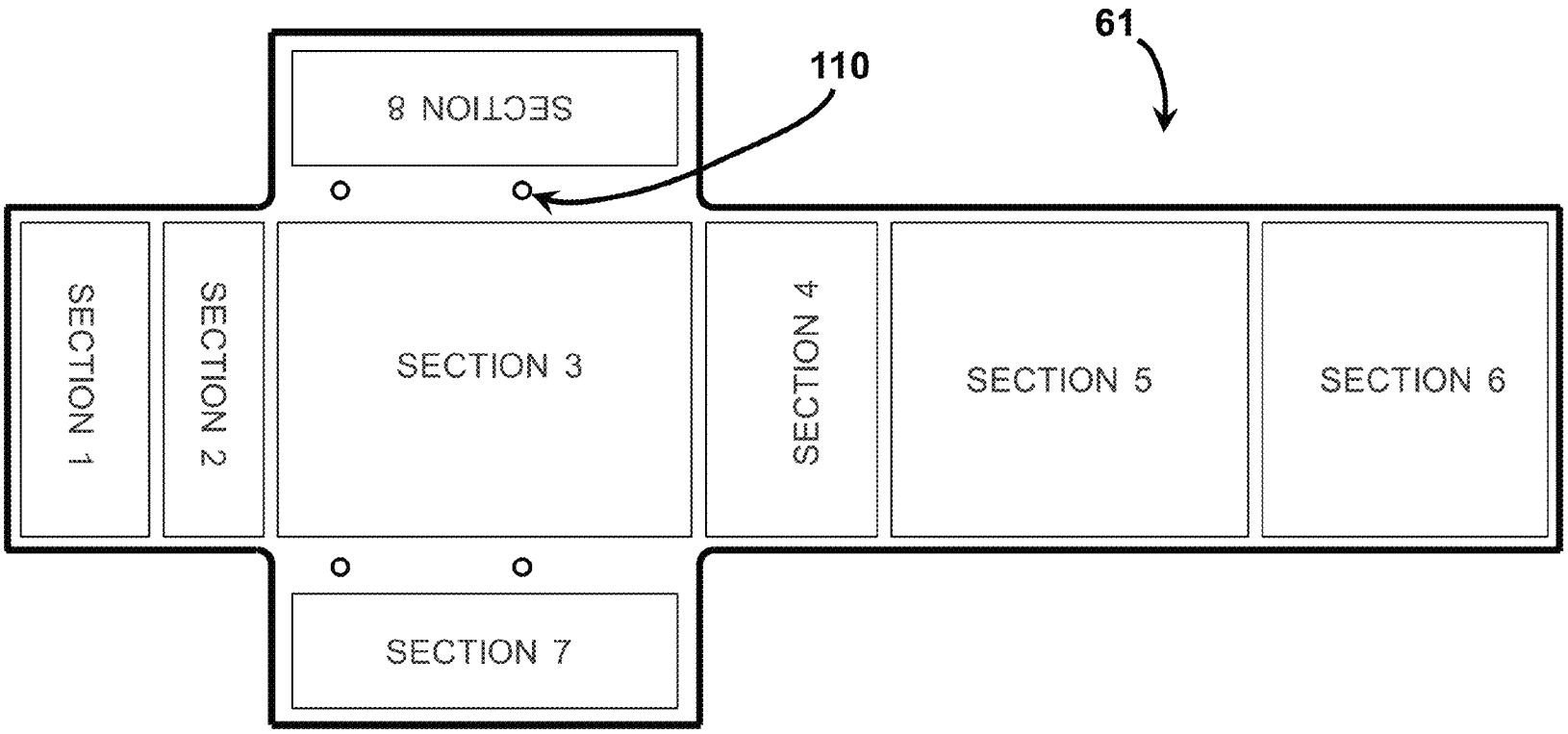
FIG. 12 is a block diagram of a label in a flat configuration showing proper text orientation according to an alternate embodiment of the invention.
Figure 13:
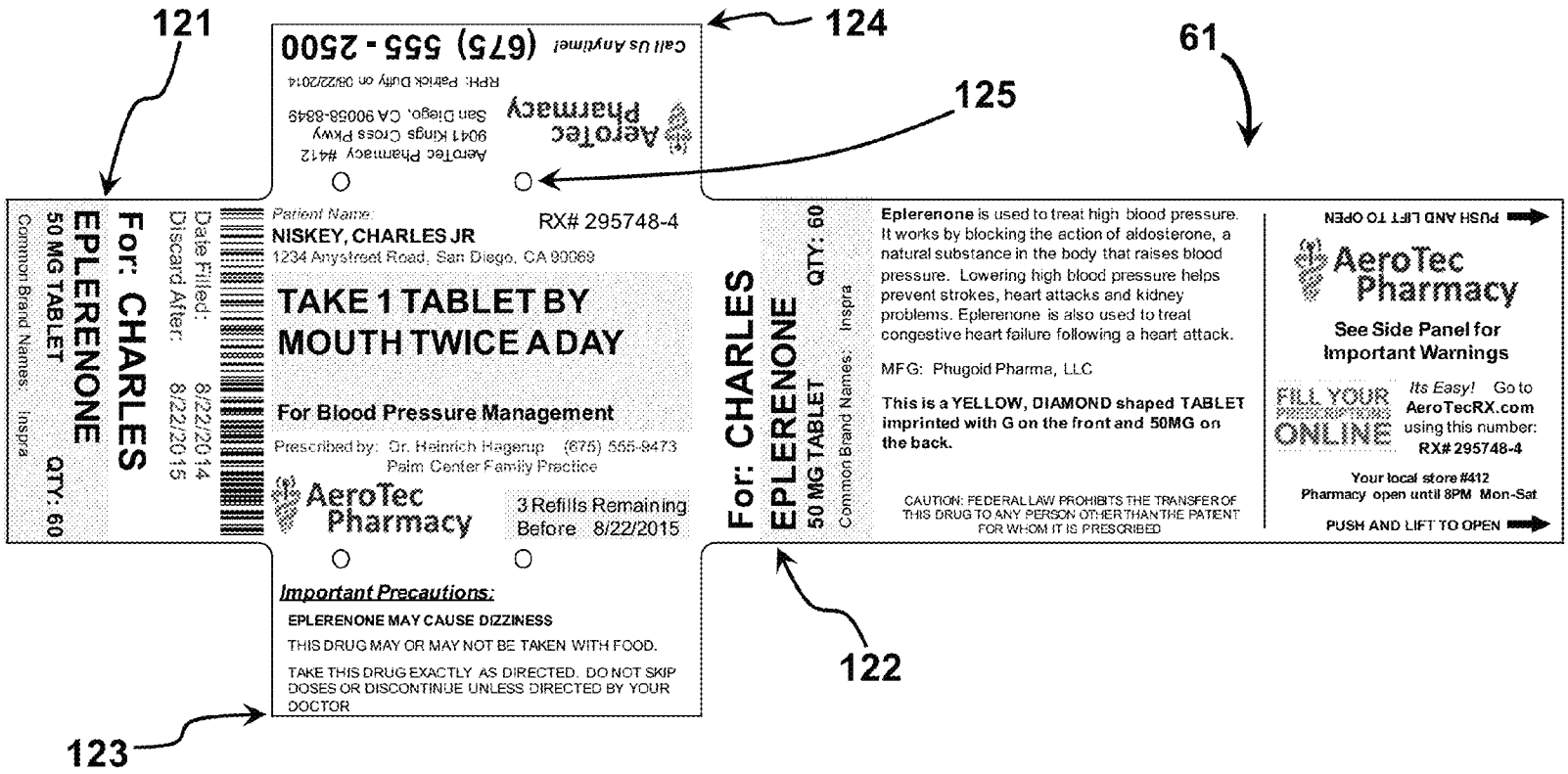
FIG. 13 is a top view of an example printed pharmacy label based on FIG. 12, in a flat configuration as it would be prior to being affixed to the container.

An alternate embodiment for the label portion of an assembled container, is depicted in FIG. 12. This alternate embodiment comprises a die-cut "winged" label portion 61. As shown in FIG. 12, this die cut label portion 61 is made to interact with the many facets of an unlabeled medication container, such as container 1 in FIG. 2A-2B. Although more expensive to produce, label portion 61 can be printed on traditional 8.5×11 die-cut sheets. The advantage of this label printing method is reduced labeling time per container as no cuts are required. FIG. 12 shows four holes 110 which align onto the nubs 29 shown in FIGS. 2A-2B. Once aligned, label portion 61 can be pressed into label guide 25 then wrapped 360 degrees around an unlabeled container 1. FIG. 13 shows an example of a fully printed winged label configuration for this alternate label embodiment. The example shown is for the prescription medication "Eplerenone" being prescribed to the hypothetical patient Charles Niskey. FIG. 13 illustrates typical information which may be desirable for the label portion 61, in the proper orientation required, including the redundant front face portion 121, rear face portion 122, left wing 123 and right wing 124, and alignment holes 125 to fit over, for example, nubs 29 as depicted in FIG. 1. This die-cut winged label, as well as an assembled container comprising a die-cut winged label, are unique in the pharmacy industry, allowing all outward facing surfaces of a pill bottle (or medication container) to be covered with a single, easy to apply adhesive label which displays significantly greater readable flat surface area than other bottles of similar dram size, which do not use the base portion or cap portion for custom labeling.

Figure 14:
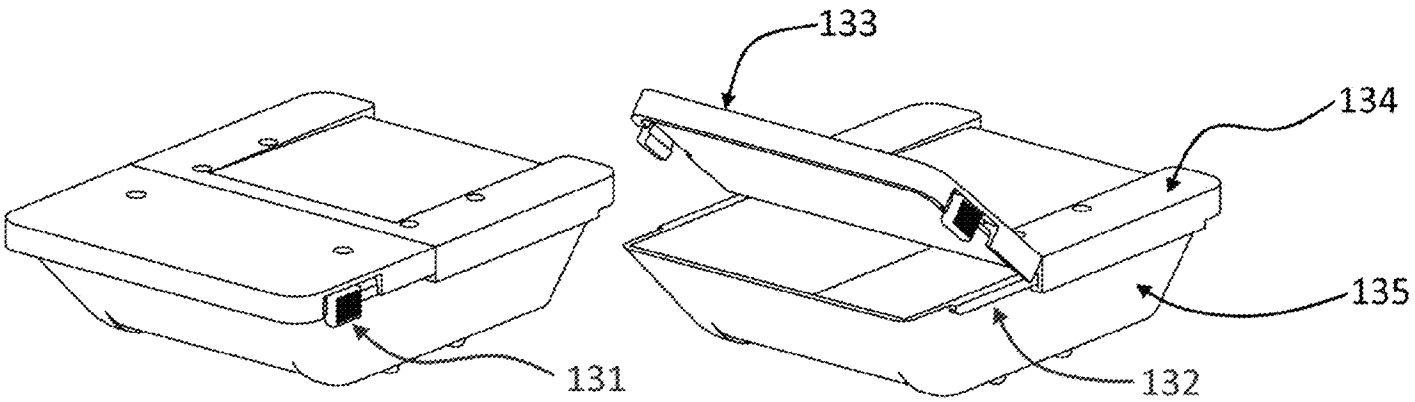
FIG. 14 is a schematic illustration including isometric views of two containers in the inverted position, without labels, according to an alternate embodiment of the invention showing Child Resistant Senior Friendly closing mechanisms.

FIG. 14 shows two unlabeled assembled containers, consistent with the first embodiment of the invention represented in FIGS. 2A-2B, with parts renumbered. Here, two assembled containers are sitting together on a support surface; one container is in the open position and one container is in the closed position. In this particular embodiment shown in FIG. 14, the hinged lid portion 133 of the cap portion 134 includes a "Child Resistant Senior Friendly" (CRSF) opening mechanism 131 on each side of the hinged lid portion of the cap portion 134, which must be simultaneously pulled into position to open the container. The container simply snaps shut to close on the extended side rails 132 on the bathtub portion 135.

The example above illustrates one method of closing the cap portion of an assembled container, including the assembled containers disclosed in FIGS. 2A-2B and FIGS. 3A-3B. However, this disclosure is no way limiting, and alternate embodiments of the invention disclosed herein may incorporate side sliders or any other form of CRSF access generally known in the art, as generally described below.

CRSF opening mechanisms have historically evolved as manufacturing technologies have improved and children become familiar with CRSF mechanisms, requiring updates or modifications to CRSF technologies from time to time. The hinged lid opening design of the present invention allows a variety of CRSF methods to be applied to the container without changing any fundamentals of the shape or design of the assembled container. Alternative embodiments with other CRSF systems that would integrate well with our invention may include side slider arrangements (as shown in FIG. 14), front slider arrangements, foldable tabs to lock the cap in place, squeeze tabs on each side, push tabs on each side, bendable deforming geometry on cap or bottle when squeezed, or numerous other methods which would not require any significant change to the fundamental design of the present invention. One notable difference between the assembled container depicted in FIGS. 1-4D and traditional pill bottles, is that common "push and turn" twist cap arrangements are not a viable option in any of the disclosed embodiments, notably setting apart the present invention from many traditional pill containers.

Novel Container Part Nesting Process

Figure 16B:
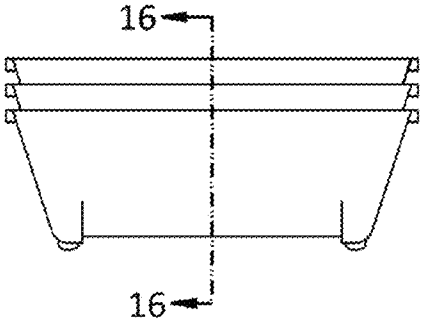
FIG. 16B is a plan view of the front of the nested bathtub portions of FIG. 16A with a longitudinal section cut 16-16, according to an embodiment of the invention.
Figure 16A:
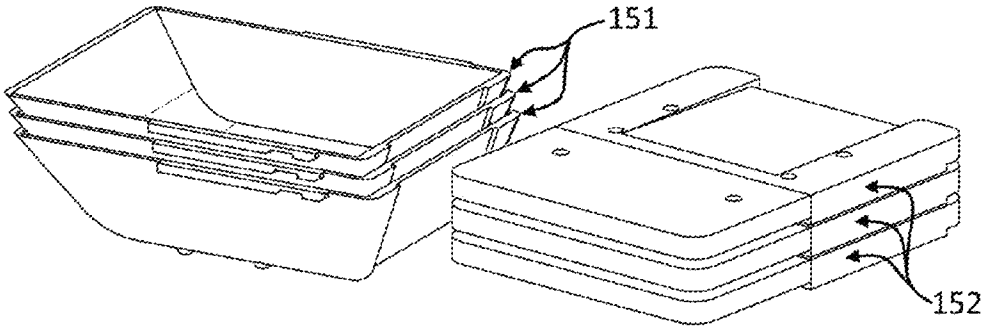
FIG. 16A is a schematic illustration including an isometric view of three nested bathtubs with three stacked cap portions of unlabeled containers resting on a support surface prior to assembly, according to an embodiment of the invention.
Figure 16D:
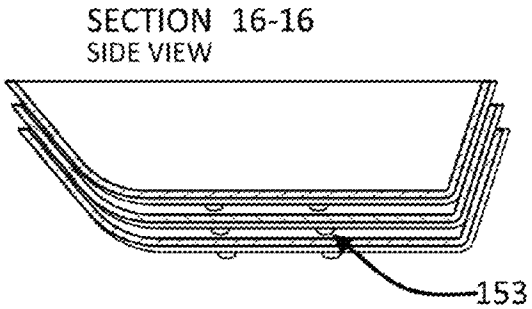
FIG. 16D is a cross sectional side view thereof for Section 16-16, according to an embodiment of the invention.
Figure 16C:
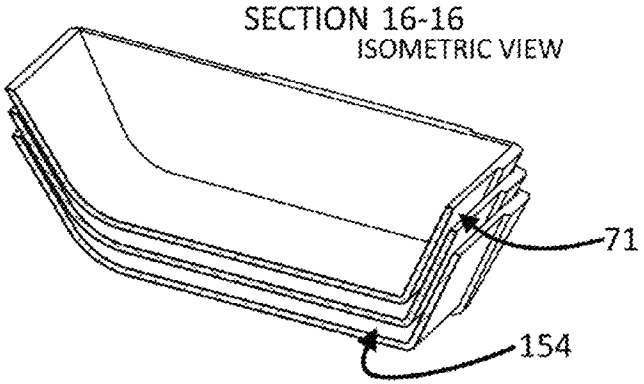
FIG. 16C is a cross sectional isometric view thereof for Section 16-16, according to an embodiment of the invention.

FIG. 16A shows a plurality of unassembled, unlabeled bathtub portions, according to an unlabeled embodiment of the invention. The components of the unassembled bathtub and cap portions of the unlabeled embodiment, as depicted in FIGS. 2A-2B, have been renumbered in FIG. 16A. In this drawing, three bathtub portions 151 are in a nested arrangement with three cap portions 152 stacked neatly by their side. As such, FIG. 16A represents the configuration used for shipping the unassembled containers at the wholesale level, illustrating the tremendous shipping efficiencies of our design. Although only three bathtub portions 151 and cap portions 152 are illustrated here, any amount of bathtub portions, as well as cap portions, could be nested together for bulk shipping. The three nested "bathtub" portions 151 of the unassembled container are shown in the front view in FIG. 16B, with a cross section 16-16 cut through the middle of the nested configuration. FIG. 16C presents an isometric view of cross section 16-16, and FIG. 16D presents a side view of cross-section 16-16, illustrating how the previously mentioned design elements further enhance the invention. In FIG. 16D, nubs 153 enforce a separation between each bathtub portion while nested so that they cannot be jammed tightly together. In FIG. 16C, the label placement guide 71 creates a continuous "air gap" 154 between each individual bathtub portion, with the air gap starting at the rear of each bathtub portion 151 and continuing into the stack. The combination of these two design elements, the label placement guide and nubs, on the bathtub portions in this nested configuration enforces a continuous "air gap pathway" between each nested bathtub portion completely eliminating the risk of adverse suction between these container parts. Additionally, as shown in FIG. 16D, the nubs 153 minimize the contact area between the individual bathtub portions ensuring that flat surfaces do not stick together. Thus, two adverse conditions are avoided (suction and stickiness) which can make nested container parts difficult, if not impossible, to remove from one another.

Advantages of Curved Section Design

Figure 17A:
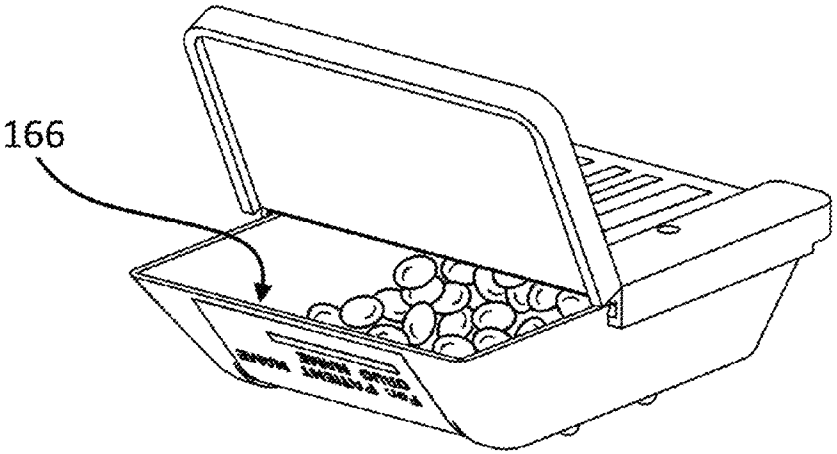
FIG. 17A is a front top isometric view of a labeled container filled with contents, according to an embodiment of the invention.
Figure 17B:
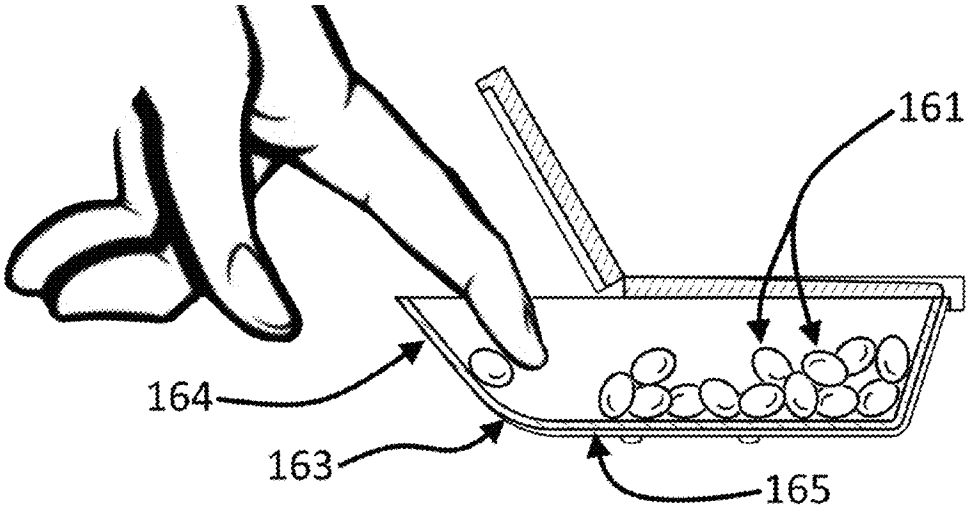
FIG. 17B is a cross sectional side view thereof showing consumer application.

FIG. 17A illustrates an assembled container, with label, filled with pills. It is identical to the labeled embodiment of the invention, as depicted in FIGS. 3A-3B, but with newly numbered components. FIG. 17B shows a side view cross section through the middle of an assembled container with pills 161 inside, including a finger sliding out a single pill. This Figure illustrates the curved section 163 of a labeled container 162 connecting the front face 164 to the top face 165. This curved section is a significant component of the invention, as this curved section in combination of the wide flat front edge 166 of the container 162 allows an index finger to be easily inserted into the container to slide out a single pill. The pill easily slides up over the gently sloping surface, onto the flat front edge of the container 162, at which point the pill can be pinched between index finger and thumb as it is removed from the bottle.

The combination of the flat front edge opening 166 and the curved section 163 tangent to the front planar face 164 is a significant improvement over other curved surface designs (U.S. Pat. No. 4,881,648 by Hagerty) as our innovation eliminates the need to fish around with a finger into a vertical bottle to slide a single pill out through a cylindrical bottle neck with curved edges. These methods are especially problematic when an elderly person must use a finger to "fish around" for a pill then pull it over the inner contours of the bottle onto the cylindrical surface. Even worse, the user may utilize the classic "shake and pour" method which regularly results in dropping the pill, dropping the bottle, or dropping both. The wide, flat container opening of our invention, in conjunction with the curved surface tangent to both the front and top surface, is particularly effective for removal of a single small pill from the bottle with little effort required.

The front flat edge opening and curved section described above are also incorporated in the unlabeled and labeled embodiments of the invention, as represented by FIGS. 1-4D. Therefore, the advantages of these components, as described above for FIG. 17, are also present in the embodiments of the invention disclosed in FIGS. 1-4D.

Advantages of the present invention have been broadly discussed above, but can be summarized as follows: improved readability of medication container contents, improved nesting of container parts; easy access to pills through improved hinged lid opening and curved section of container surface; reduced labeling, assembly, manufacturing, and overall container costs; and improved stackability of multiple containers by a user within the home.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. An assembled three-part assembled prescription medication container comprising:

a cap portion;

wherein said cap portion further comprises:

a planar bottom face with integrated hinged lid portion, wherein said hinged lid portion, when closed, is an extension of said planar bottom face; and four planar side faces comprising a front face, rear face, right side and left side;

a bathtub portion;

wherein said bathtub portion comprises:

a generally planar top face, situated away from and generally parallel to said bottom face of said cap portion;

four generally planar side faces comprising a left side, right side, front face and rear face;

wherein said four side faces of said bathtub portion are angled slightly away from vertical to create a bathtub portion in the general shape of a truncated pyramid;

wherein said four side faces of said bathtub portion are truncated prior to reaching any apex, by said generally planar top face, and wherein said rear face, left side and right side are molded to said generally top face;

at least one curved transition section;

wherein said at least one curved transition section is molded to said front face and to said generally planar top face of said bathtub portion;

and an open bottom section;

wherein said open bottom section is permanently affixed to said cap portion such that integrated hinged lid portion can open and close;

a label portion permanently affixed to said prescription medication container;

wherein said label portion comprises:

a label section bearing printed pharmacy information, secured to said curved transition section, and additional label sections bearing printed pharmacy information, secured to said front face, rear face, top face, and said left and right side of said bathtub portion, and said bottom face of said cap portion; and wherein such label portion wraps approximately 360 degrees around said container such that said label section bearing printed pharmacy information, secured to said bottom face of said cap portion, is obscured from view when said bottom face of said cap portion is set on a support surface; and wherein said label sections bearing printed pharmacy information, secured to said rear face, front face, left and right side, top face and curved transition section of said bathtub portion, are oriented to be readable on each viewable face of said container, when said bottom face of said cap portion is set on a support surface;

and wherein when assembled for stacking, said container rests on said planar bottom face of said cap portion in the highly stable shape of a truncated pyramid.

2. The container of claim 1, wherein said integrated hinge portion comprises:

a hinge traversing from the left side to the right side of said planar bottom face of said cap portion in roughly the midpoint of said bottom face of said cap portion;

wherein said hinge allows said integrated hinge portion to open and close.

3. The container of claim 2, further comprising:

a series of nubs spaced on said top face of said bathtub portion; and a series of depressions equally spaced on said bottom face of said cap portion;

wherein at least four of said nubs on said top face of said bathtub portion of said assembled three-part prescription medication container are spaced to mate with at least four spaced depressions on a bottom face of a second identical assembled three-part prescription medication container; and wherein said nubs and depression spacing on two or more of said assembled three-part prescription medication containers allows said two or more of said assembled three-part prescription medication containers to be stacked at an ascending angle from vertical.

4. The container of claim 3, wherein said nub and depression spacing on said prescription medication container allows said printed pharmacy information on said label section secured to said front face of said bathtub portion to remain unobscured to a viewer, when a series of said medication containers are stacked; and wherein when stacked, said bottom face of said cap portion of a stacked container stacks on said top face of said bathtub portion of an underlying assembled container; and wherein said nub and depression spacing, coupled with said truncated pyramid container shape, creates a stable arrangement of at least three stacked prescription medication containers, when said containers are filled with medication.

5. The container of claim 3, wherein said nub and depression spacing on said prescription medication container allows said printed pharmacy information on said label section secured to said rear face of said bathtub portion to remain unobscured to a viewer, when a series of said containers are stacked; and wherein said nub and depression spacing coupled with said prescription medication container shape creates a stable arrangement at least three stacked prescription medication containers when said containers are filled with typical medication.

6. The container of claim 3, wherein said right and left sides of said bathtub portion are generally angled 0 to 45 degrees from vertical, away from said top face of said bathtub portion; and wherein said rear face of said bathtub portion is generally angled between 0 and 45 degrees from vertical, away from said top face of said bathtub portion; and wherein said front face of said bathtub portion is generally angled between 10 and 60 degrees from vertical, away from said top face of said bathtub portion.

7. The container of claim 4, wherein said bathtub portion further comprises a depressed rectangular section which extends from said front face over said top face and rear face of said bathtub portion; and wherein said cap portion further comprises a depressed rectangular section extending over a portion of said bottom face of said cap portion; and wherein said depressed rectangular sections form a label placement guide to aid a user in attaching or printing a label portion to said assembled container; and wherein if said label portion attaches to said container, said label portion comprises an adhesive portion that affixes to said container when it is attached.

8. The container of claim 7, wherein prior to assembly of said container, two or more of said bathtub portions of said prescription medication container may be easily nested; and wherein said nubs and said label placement guide create an air gap between said two or more bathtub portions of said prescription medication container that prevents sticking and/or suction of said two or more bathtub portions, when said bathtub portions are nested.

* * * * *